US011939145B2

(12) United States Patent
Searle et al.

(10) Patent No.: US 11,939,145 B2
(45) Date of Patent: Mar. 26, 2024

(54) CARBON FIBER AIR CARGO CONTAINER

(71) Applicant: GSTC LLC, Scottsdale, AZ (US)

(72) Inventors: Gideon P. Searle, Scottsdale, AZ (US); Theodore Bobrick Root, Jr., Charlotte, NC (US)

(73) Assignee: GSTC LLC, Scottsdale, AZ (US)

( * ) Notice: Subject to any disclaimer, the term of this patent is extended or adjusted under 35 U.S.C. 154(b) by 6 days.

(21) Appl. No.: 17/843,539

(22) Filed: Jun. 17, 2022

(65) Prior Publication Data

US 2022/0402690 A1 Dec. 22, 2022

Related U.S. Application Data

(60) Provisional application No. 63/213,491, filed on Jun. 22, 2021.

(51) Int. Cl.
*B65D 88/14* (2006.01)
*B65D 90/02* (2019.01)

(52) U.S. Cl.
CPC ..... *B65D 88/14* (2013.01); *B65D 90/02* (2013.01)

(58) Field of Classification Search
CPC ..... B65D 2577/00–2091; B65D 88/14; B65D 90/02; B65D 88/528; B65D 90/0053; B65D 90/022
See application file for complete search history.

(56) References Cited

U.S. PATENT DOCUMENTS

| | | | | |
|---|---|---|---|---|
| 5,360,129 | A * | 11/1994 | Lee | F42B 39/20 220/1.5 |
| 5,667,002 | A | 9/1997 | Neustadt | |
| 5,741,042 | A | 4/1998 | Livingston et al. | |
| 5,979,684 | A | 11/1999 | Ohnishi et al. | |
| 6,019,237 | A * | 2/2000 | Durham | B65D 88/14 220/88.1 |
| 6,092,272 | A * | 7/2000 | Durham | B65D 88/14 220/88.1 |
| 7,059,488 | B2 | 6/2006 | Myers | |
| 7,334,697 | B2 | 2/2008 | Myers et al. | |
| 8,469,215 | B2 | 6/2013 | Giesbers | |
| 9,828,164 | B2 | 11/2017 | Denson | |
| 9,834,374 | B2 | 12/2017 | Pherson | |
| 9,850,063 | B2 | 12/2017 | Huber | |
| 10,029,439 | B2 | 7/2018 | Kawka | |
| 10,589,919 | B2 | 3/2020 | Losco | |
| 2004/0011789 | A1* | 1/2004 | Wang | B65D 88/14 220/252 |

(Continued)

FOREIGN PATENT DOCUMENTS

JP S5073782 A 6/1975

*Primary Examiner* — Kareen K Thomas
(74) *Attorney, Agent, or Firm* — NEO IP

(57) ABSTRACT

The present invention is directed to an air cargo container formed from a plurality of fiber-reinforced (e.g., carbon fiber) composite panels. The use of fiber reinforcement provides for an increased strength-to-weight ratio as compared to existing air cargo containers. Furthermore, the present invention also includes air cargo containers having convex side panels, which decreases the chance of damage to the container or to its contents in the event of an impact. The air cargo container is collapsible, with panels able to be stacked for more efficient storage.

8 Claims, 11 Drawing Sheets

(56) References Cited

U.S. PATENT DOCUMENTS

| | | | | |
|---|---|---|---|---|
| 2006/0076350 | A1* | 4/2006 | Weerth | B65D 90/325 220/88.1 |
| 2006/0277938 | A1* | 12/2006 | Meyer | F25D 11/003 312/401 |
| 2007/0289976 | A1* | 12/2007 | Meyer | F25D 17/06 220/592.09 |
| 2008/0174149 | A1 | 7/2008 | Simms et al. | |
| 2011/0247958 | A1 | 10/2011 | Lucas et al. | |
| 2014/0008358 | A1* | 1/2014 | Fingerhut | B65D 85/00 220/1.5 |
| 2014/0251988 | A1 | 9/2014 | Amato et al. | |
| 2020/0384719 | A1 | 12/2020 | Benson | |
| 2021/0094748 | A1 | 4/2021 | Lindsay et al. | |

* cited by examiner

CARBON FIBER AIR CARGO CONTAINER

CROSS REFERENCES TO RELATED APPLICATIONS

This application is related to and claims priority from the following U.S. patent application. This application claims priority to and the benefit of U.S. Provisional Patent Application No. 63/213,491, filed Jun. 22, 2021, which is incorporated herein by reference in its entirety.

BACKGROUND OF THE INVENTION

1. Field of the Invention

The present invention relates to air cargo containers, and more specifically to air cargo containers comprising carbon fiber panels.

2. Description of the Prior Art

It is generally known in the prior art to provide air cargo containers for storing solids and liquids on aircraft. Existing air cargo containers have are typically made from metals, such as aluminum, or from fiberglass.

Prior art patent documents include the following:

U.S. Pat. No. 9,834,374 for Air cargo container by inventor Pherson, filed Jan. 27, 2016 and issued Dec. 5, 2017, discloses a composite panel for air cargo containers including a fire resistant, closed cell foam core, a skin attached to at least one surface of the core formed by fire resistant fibers in a matrix resin, wherein the panel will contain an internal fire with temperatures of up to 1500° F. for a period of at least 4 hours.

U.S. Pat. No. 10,029,439 for Composite sheet and cargo container comprising same by inventor Kawka, filed Mar. 18, 2016 and issued Jul. 24, 2018, discloses a non-rigid composite sheet comprising in order (i) a first component comprising at least one first fabric of continuous filament yarns having a tenacity of at least 11 g/dtex and a first polymeric layer, (ii) a second component comprising at least one second fabric of continuous filament glass yarns, the at least one second fabric being adjacent to the at least one first fabric of the first component, and (iii) a third component comprising a second polymeric layer.

U.S. Pat. No. 10,589,919 for Thermally insulated transport container comprising thermal insulation resting against the walls, and wall structure of a container of said type by inventor Losco, filed Oct. 26, 2015 and issued Mar. 17, 2020, discloses a thermally insulated transport container with a housing for forming a space for goods, with walls and a thermal insulation abutting the walls as well as a wall structure of such a container. In particular, the invention relates to such a container as an air cargo container. According to the invention, sandwich plastic plates are provided as walls, with a honeycomb core welded on both sides to one covering ply, respectively, the honeycomb core and the covering plies consisting of a thermoplastic material, preferably PP. In this case, the walls are, in particular, a thermoplastic sandwich panel, consisting substantially of a PP (polypropylene) honeycomb core and PP covering layers, in particular glass-fiber reinforced, which are, with regard to the materials, homogenously connected to each other by thermally fused connection. Such plates are offered, for example, by Wihag Composites GmbH & Co. KG under the trademark MonoPan®, which are preferred in this case. The use of thermoplastic material makes it possible for adjacent sandwich plastic plates to be attached to each other by welding, particularly in the region of the edges. In particular, it is thus possible to produce largely frameless and thus lighter transport containers.

U.S. Pat. No. 9,850,063 for Freight floor, freight container, use of a multilayer panel to produce a freight floor, and method for producing a freight floor by inventor Huber, filed Jun. 6, 2012 and issued Dec. 26, 2017, discloses a freight floor having a multilayer construction and that is formed as a composite material, comprising a core layer of carbon-fiber-reinforced and/or glass-fiber-reinforced plastic and a seating layer of a metal alloy, in particular an aluminum alloy.

U.S. Patent Publication No. 2011/0247958 for Lightweight unit load device by inventors Lucas et al., filed Oct. 16, 2009 and published Oct. 13, 2011, discloses a unit load device constructed from fiber reinforced polymer matrix composite materials. Individual panels of the unit load device may be customized with composite materials and patterns. The joints are adapted to receive the ends of the panels of the unit load device and may further be customized with fiber reinforced composite materials to strengthen the joint. Some embodiments provide for construction of a unit load device from a variety of fiber reinforcing materials utilizing a matrix of thermoplastic polymers with similar softening temperatures. Each component part within the container was designed and/or created to address the specific needs of the particular part. The unit load devices described herein provide for all composite containers with a significant weight savings from conventional unit load devices U.S. Patent Publication No. 2020/0384719 for Composite structures, composite storage tanks, vehicles including such composite storage tanks, and related systems and methods by inventor Benson, filed Jun. 5, 2020 and published Dec. 10, 2020, discloses a composite storage tank including a wall structure including at least three regions including an inner region, an outer region, and at least one permeation barrier. Another region may be optionally incorporated for venting potential permeation of fluids. The at least one permeation barrier and/or the venting layer may be strategically positioned between the inner region and the outer region to reduce or at least partially prevent fluid permeation of the inner region or the outer region. A vehicle may include such a composite storage tank. Methods of forming a composite fluid storage tank may include forming an inner composite region, applying a permeation barrier to an outer surface of the inner composite region, forming an outer composite region, and curing the inner composite region and the outer composite region with the permeation barrier to form the composite fluid storage tank.

U.S. Pat. No. 7,334,697 for ISO container by inventors Myers et al., filed Oct. 20, 2005 and issued Feb. 26, 2008, discloses a lightweight transportable container in which the wall, roof, and floor of the container are laminated panels bonded together to form a rigid monolithic structure. The container is formed of nonmetallic materials, is stackable, and has a payload more than eight times greater than the tare weight of the container. The container is particularly useful in hostile and extreme temperature environments and is designed to withstand the application of numerous forces from various directions, such as those typically applied, for example, in ISO certification testing.

U.S. Pat. No. 7,059,488 for ISO fittings for composite structures by inventor Myers, filed Jun. 30, 2003 and issued Jun. 13, 2006, discloses an apparatus and method for removably attaching an ISO corner fitting to a composite material shipping container. The apparatus and method of the invention comprises a post that is anchored in the composite material frame of the container. The ISO corner fitting is then attached to the post using a connector assembly that may be engaged and disengaged as needed to attach and detach the ISO corner fitting from the post. The post has a plurality of grooves formed thereon that help hold the post in the composite material of the shipping container. The grooves transfer any tension or compression loads that are applied to the ISO corner fitting directly to the shipping container.

U.S. Pat. No. 5,979,684 for Cargo container by inventors Ohnishi et al., filed Jul. 12, 1996 and issued Nov. 9, 1999, discloses a cargo container wherein at least two walls adjacent to each other are constituted using an integrally formed FRP panel, and a cargo container having a sandwich panel including a core and FRP skins as a main rigidity-maintaining member and wherein at least two walls adjacent to each other are formed integrally. The cargo container according to the invention is light and has sufficient strength and rigidity as compared with a conventional aluminum-alloy container, and can reduce time and cost required for fabrication and production thereof. Further, the cargo container constituted using the sandwich panel including the core and the FRP skins has excellent freezing, refrigerating, cold insulating and heat insulating performances.

U.S. Patent Publication No. 2008/0174149 for Structural insulation panel by inventors Simms et al., filed Jan. 18, 2007 and published Jul. 24, 2008, discloses a structural insulation panel for use with a truck or similar vehicle to provide structural support and thermal, acoustic, and vibration insulation. The structural insulation panel includes two fiberglass layers sandwiching and bonded to a foam core. The structural insulation panel may be used in the construction of truck cabs, sleeper boxes, roof caps, cab extenders, and other vehicle components.

U.S. Pat. No. 5,741,042 for Intermodal container including double lap shear joints by inventors Livingston et al., filed Mar. 23, 1995 and issued Apr. 21, 1998, discloses a vehicle body, such as an intermodal shipping container, including upper and lower rail assemblies at the longitudinal corners of the body. The lower rail assemblies interconnect the side walls of the container with the bottom wall of the container, and the lower rail assemblies each sandwich and are adhesively bonded to the walls they interconnect to form double lap shear joints that secure the walls together without the use of fasteners and that provide double adhesive seals to make the container weathertight.

U.S. Pat. No. 8,469,215 for Collapsible freight container by inventor Giesbers, filed Mar. 12, 2010 and issued Jun. 25, 2013, discloses a collapsible freight container including a floor panel, a roof panel and two longitudinal side walls connected to the floor panel and the roof panel. Each side wall includes a first and a second part, which are connected by a hinged joint, such that the first part can hinge towards the second part of the same side wall about a hinge axis extending in the longitudinal direction of the freight container. Each corner of the freight container is provided with a corner pin. The corner pins can be moved simultaneously, using an unlocking mechanism, from a locked position, in which the side walls are rigidly connected to the roof panel and the floor panel by the corner pins, to an unlocked position, in which the side walls are hinged to the roof panel and the floor panel by the corner pins.

U.S. Patent Publication No. 2014/0251988 for Freight container by inventors Amato et al., filed Jun. 13, 2012 and published Sep. 11, 2014, discloses a freight container comprising a floor, a roof, and a plurality of walls comprising at least a front end wall and side walls. These walls and roof each comprise at least one panel having two surface dimensions in relation to the container. The panels comprise a fibre-reinforced wall material, comprising a first and a second outer fibre layer, and at least a first and a second intermediate fibre layer in between the first and second outer fibre layers. The fibres of the outer fibre layers are aligned along an outer fibre direction and the fibres of the intermediate fibre layers are aligned respectively along a first and second intermediate fibre direction which are mutually transverse and inclined with respect to the outer fibre direction. The outer fibre direction is aligned with a shortest of said surface dimensions of said panels.

U.S. Pat. No. 9,828,164 for Intermodal container and method of constructing same by inventor Denson, filed May 7, 2015 and issued Nov. 28, 2017, discloses an intermodal container including a supporting frame having a rectangular base; a first pair of upright posts extending upwardly from the rectangular base; and a first cross-beam coupling the first pair of upright posts. A second pair of upright posts extends upwardly from the rectangular base proximate an opposite end thereof, and a second cross-beam couples the second pair of upright posts. A longitudinally extending connector beam has a first end coupled to the first cross-beam, and a second end coupled to the second cross-beam. The intermodal container further includes a plurality of panels, and each panel is made of fiber reinforced plastic and insulation foam that have been integrally molded together. The panels are coupled to the supporting frame and serve as side walls, end wall, roof, and floor of the container. A method for constructing an intermodal container is also disclosed.

SUMMARY OF THE INVENTION

The present invention relates to air cargo containers, specifically air cargo containers comprising carbon fiber panels.

It is an object of this invention to provide a light weight air cargo container having equivalent or improved properties relative to current fiberglass and metal-based containers.

In one embodiment, the present invention is directed to an air cargo container, including a top panel and a bottom panel, a plurality of side panels, wherein each of the plurality of side panels are attached to both the top panel and the bottom panel via fasteners, and at least one retaining bag attached to an interior surface of the top panel, the bottom panel, and/or one or more of the plurality of side panels, wherein the top panel, the bottom panel, and the plurality of side panels define a sealed interior compartment of the air cargo container, wherein at least one of the plurality of side panels is convex relative to the sealed interior compartment of the air cargo container, and wherein the at least one retaining bag includes packaging material and is operable to be inflated and/or deflated by a pump.

In another embodiment, the present invention is directed to an air cargo container, including a frame defining a skeleton of the air cargo container, a top panel and a bottom panel, attached to the frame via fasteners, a plurality of side panels, each attached to the frame via fasteners, and at least one retaining bag attached to an interior surface of the top panel, the bottom panel, and/or one or more of the plurality of side panels, wherein the frame, the top panel, the bottom panel, and the plurality of side panels define a sealed interior compartment of the air cargo container, wherein at least one of the plurality of side panels is convex relative to the sealed interior compartment of the air cargo container, and wherein the at least one retaining bag includes packaging material and is operable to be inflated and/or deflated by a pump.

In yet another embodiment, the present invention is directed to an air cargo container, including a top panel and a bottom panel, a plurality of side panels, wherein each of the plurality of side panels are attached to both the top panel and the bottom panel via fasteners, and at least one retaining bag attached to an interior surface of the top panel, the bottom panel, and/or one or more of the plurality of side panels, wherein the top panel, the bottom panel, and the plurality of side panels define a sealed interior compartment of the air cargo container, wherein the top panel, the bottom panel, and each of the plurality of side panels have approximately the same length, width, and thickness, and wherein the at least one retaining bag includes packaging material and is operable to be inflated and/or deflated by a pump.

These and other aspects of the present invention will become apparent to those skilled in the art after a reading of the following description of the preferred embodiment when considered with the drawings, as they support the claimed invention.

DETAILED DESCRIPTION

Figure 1:
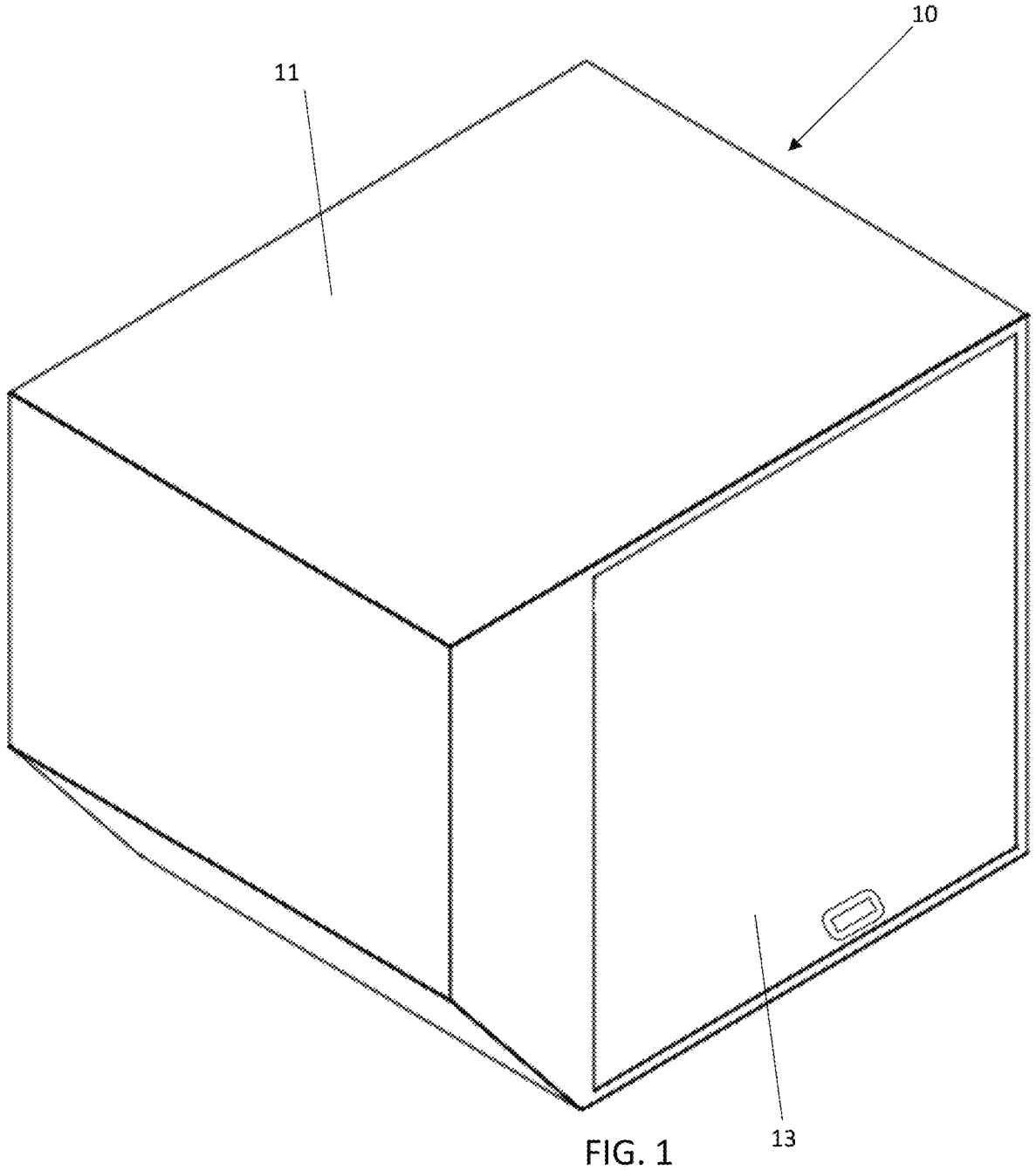
FIG. 1 illustrates an isometric view of a container according to one embodiment of the present invention.

The present invention is generally directed to air cargo containers, and more specifically to air cargo containers including carbon fiber panels.

In one embodiment, the present invention is directed to an air cargo container, including a top panel and a bottom panel, a plurality of side panels, wherein each of the plurality of side panels are attached to both the top panel and the bottom panel via fasteners, and at least one retaining bag attached to an interior surface of the top panel, the bottom panel, and/or one or more of the plurality of side panels, wherein the top panel, the bottom panel, and the plurality of side panels define a sealed interior compartment of the air cargo container, wherein at least one of the plurality of side panels is convex relative to the sealed interior compartment of the air cargo container, and wherein the at least one retaining bag includes packaging material and is operable to be inflated and/or deflated by a pump.

In another embodiment, the present invention is directed to an air cargo container, including a frame defining a skeleton of the air cargo container, a top panel and a bottom panel, attached to the frame via fasteners, a plurality of side panels, each attached to the frame via fasteners, and at least one retaining bag attached to an interior surface of the top panel, the bottom panel, and/or one or more of the plurality of side panels, wherein the frame, the top panel, the bottom panel, and the plurality of side panels define a sealed interior compartment of the air cargo container, wherein at least one of the plurality of side panels is convex relative to the sealed interior compartment of the air cargo container, and wherein the at least one retaining bag includes packaging material and is operable to be inflated and/or deflated by a pump.

In yet another embodiment, the present invention is directed to an air cargo container, including a top panel and a bottom panel, a plurality of side panels, wherein each of the plurality of side panels are attached to both the top panel and the bottom panel via fasteners, and at least one retaining bag attached to an interior surface of the top panel, the bottom panel, and/or one or more of the plurality of side panels, wherein the top panel, the bottom panel, and the plurality of side panels define a sealed interior compartment of the air cargo container, wherein the top panel, the bottom panel, and each of the plurality of side panels have approximately the same length, width, and thickness, and wherein the at least one retaining bag includes packaging material and is operable to be inflated and/or deflated by a pump.

None of the prior art discloses forming an air cargo container, also commonly known as a Unit Load Device (ULD), using panels comprising carbon fiber. While some prior containers disclose the use of carbon fiber for specific parts of the container, such as only the base of a container, as in U.S. Pat. No. 9,850,063, such documents do not disclose using carbon fiber for all of the panels making up the container. Furthermore, previously disclosed air cargo containers have straight planar side panels, which increases the chance that the containers will be damaged if something impacts the side of the container, or if the container falls on its side. Therefore, there is a need for air cargo containers having improved impact resistance.

In one embodiment, the panels comprise carbon fiber having fire resistant properties satisfying the ISO 19281 (2016) standard for air cargo containers. Ensuring air cargo containers have fire resistant qualities is important in the event that something within the containers ignites and/or explodes. Furthermore, in one embodiment, the carbon fiber has a coefficient of thermal expansion with a magnitude less than $2*10^{-6}$ per ° F. In another embodiment, the carbon fiber has a coefficient of thermal expansion with a magnitude less than $1*10^{-6}$ per ° F. Because thermal expansion is essentially negligible, the risk of containers expanding or contracting during different flight conditions is minimized. The containers therefore provide a safety mechanism to prevent cargo elements from causing aircraft carrying the cargo elements to crash or otherwise need to land unexpectedly.

Air cargo containers are most commonly formed from aluminum. Aluminum has both a higher density than carbon fiber and weaker structural characteristics, such as tensile strength and stiffness. Therefore, aluminum containers are often substantially heavier than an equivalent carbon fiber container. As a result, fewer containers are able to be loaded onto aircraft and the containers are harder to lift than carbon fiber containers. However, carbon fiber air cargo containers have yet to be used. Thus, it is desirous to provide a carbon fiber air cargo container in order to reduce air cargo weight and improve ease of loading.

Additionally, it is beneficial to utilize air cargo containers that are collapsible. Collapsibility improves the ease with which containers are able to be broken down and stored when not in use. Making air cargo containers, in particular, collapsibility is advantageous as it allows aircraft to use a wider variety of differently sized and/or shaped containers for different flights, as the containers not being employed are easily storable elsewhere without taking up critical cargo space. Therefore, it is desirous to provide an air cargo container that is collapsible.

Referring now to the drawings in general, the illustrations are for the purpose of describing one or more preferred embodiments of the invention and are not intended to limit the invention thereto.

FIG. 1 illustrates an isometric view of a container according to one embodiment of the present invention. The container 10 includes a plurality of panels 11 defining an interior chamber operable to hold a number of items. At least one of the plurality of panels 11 includes a door 13 operable to hingedly and/or slidably open. In one embodiment, the container 10 includes a means for cooling, including dry ice and/or an internal air conditioning system. In another embodiment, the container 10 does not include any cooling means.

Figure 2:
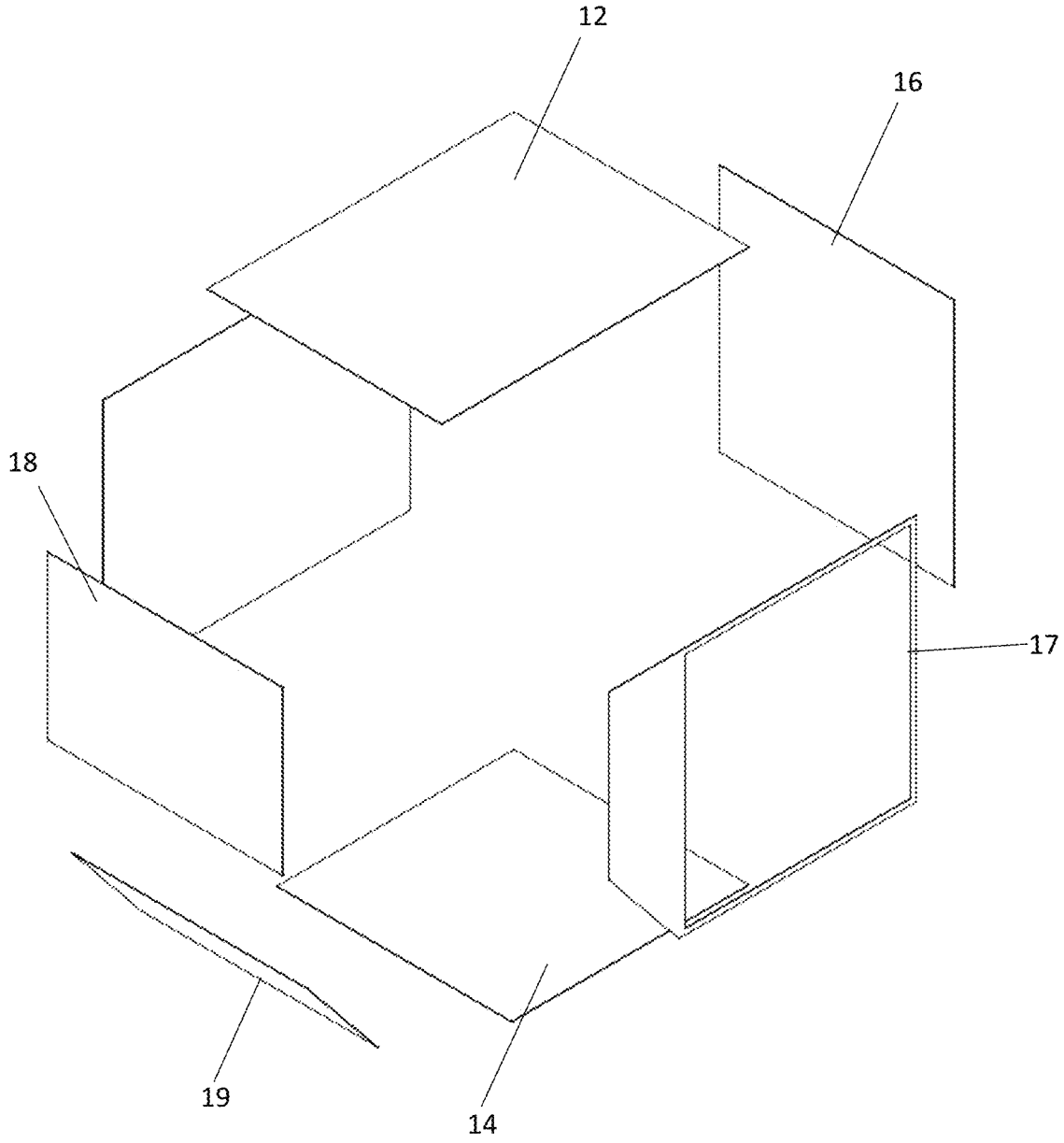
FIG. 2 illustrates an isometric exploded view of a container according to one embodiment of the present invention.

FIG. 2 illustrates an isometric exploded view of a container according to one embodiment of the present invention. The container 10 includes a top panel 12, a bottom panel 14, a rear panel 16, two side panels 17, and a front panel 18. In one embodiment, as shown in FIG. 2, the bottom panel 14 has a different length than the top panel 12, as is standard for some forms of air cargo containers. A first front panel 18 extends downwardly from the top panel 12 in a direction orthogonal to the top panel 12. A second front panel 19 extends from a bottom edge of the first front panel 18 to a front edge of the bottom panel 14, thereby allowing the first front panel 18 and the second front panel 19 to connect the top panel 12 and the bottom panel 14. The second front panel 19 extends from the first front panel 18 at an angle between 25 and 65 degrees in one embodiment. In one embodiment, at least one of the two side panels 17 includes at least one door operable to be opened, closed, locked, and unlocked. The at least one door is used to access the interior chamber of the container 10, such that goods are able to be placed into and taken out of the container 10. In one embodiment, one or more panels are attached to other panels via at least one hinge. The panels attached via the at least one hinge are able to open inwardly and/or outwardly. In another embodiment, panels are attached to other panels via at least one removable fastener (e.g., a bolt, nail, screw, etc.), which is able to be removed in order to open the panel. In a preferred embodiment, all panels of the container are attached via the same fastener, allowing for quicker construction and deconstruction of the container. This quick deconstruction is markedly distinct from the prior art, which requires more complex sets of tools in order to deconstruct. In one embodiment, one or more panels include at least one locking mechanism, which is operable to maintain the panel in a closed condition until the locking mechanism is released. Examples of locking mechanisms include, but not are not limited to, bolts and/or latches.

Figure 3:
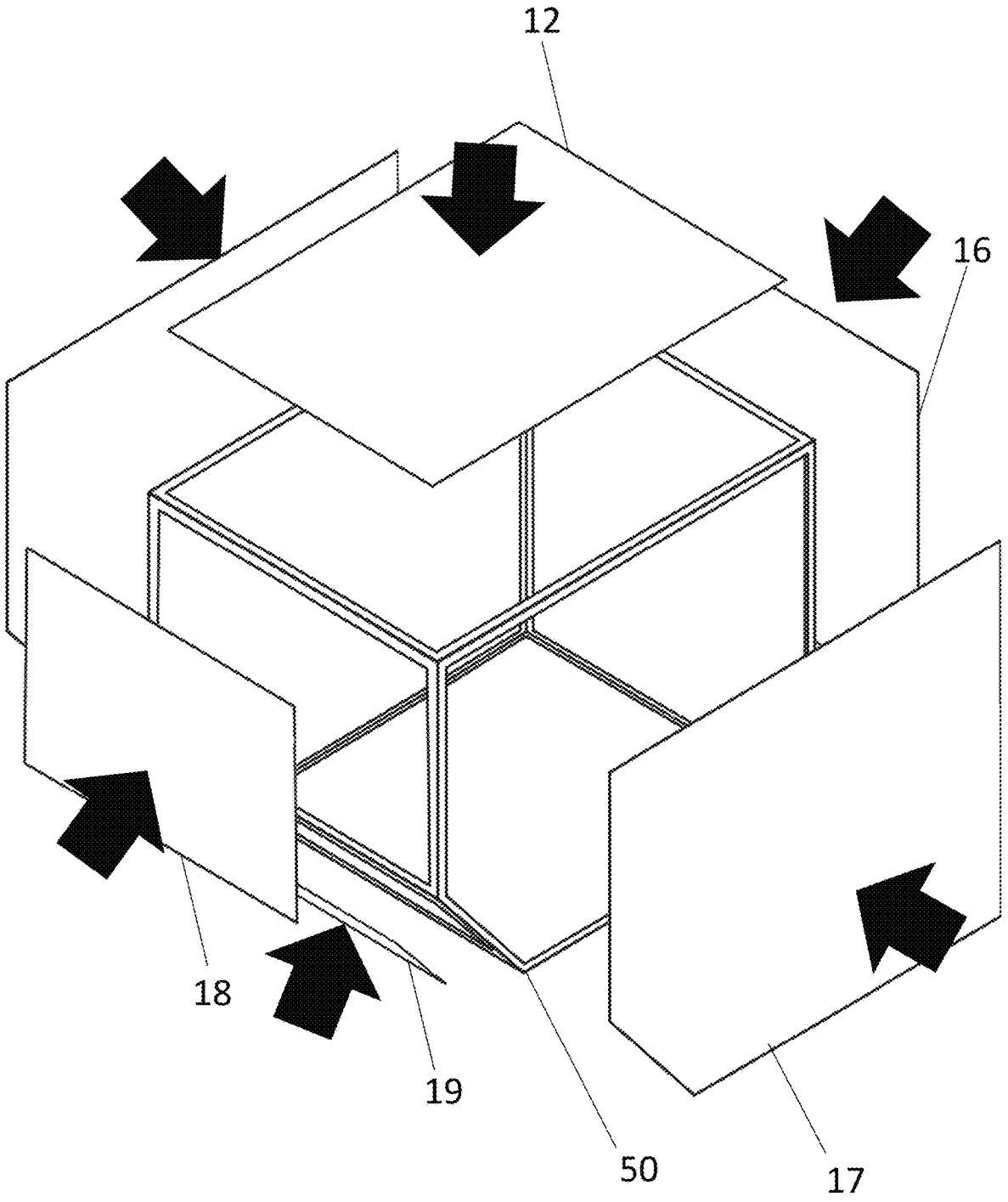
FIG. 3 illustrates an isometric exploded view of a container including a frame according to one embodiment of the present invention.

FIG. 3 illustrates an isometric exploded view of a container including a frame according to one embodiment of the present invention. In one embodiment, the first front panel 18, the second front panel 19, the top panel 12, the bottom panel, the two side panels 17, and the rear panel 16 are all attached to a frame 50 by fasteners (e.g., screws, hex nuts, nails, quick release latches, etc.). The frame 50 provides a skeletal outline of the container for structural support, but does not include any side faces. Therefore, when the panels are removed from the frame 50, the interior of the container is able to be accessed.

Figure 4:
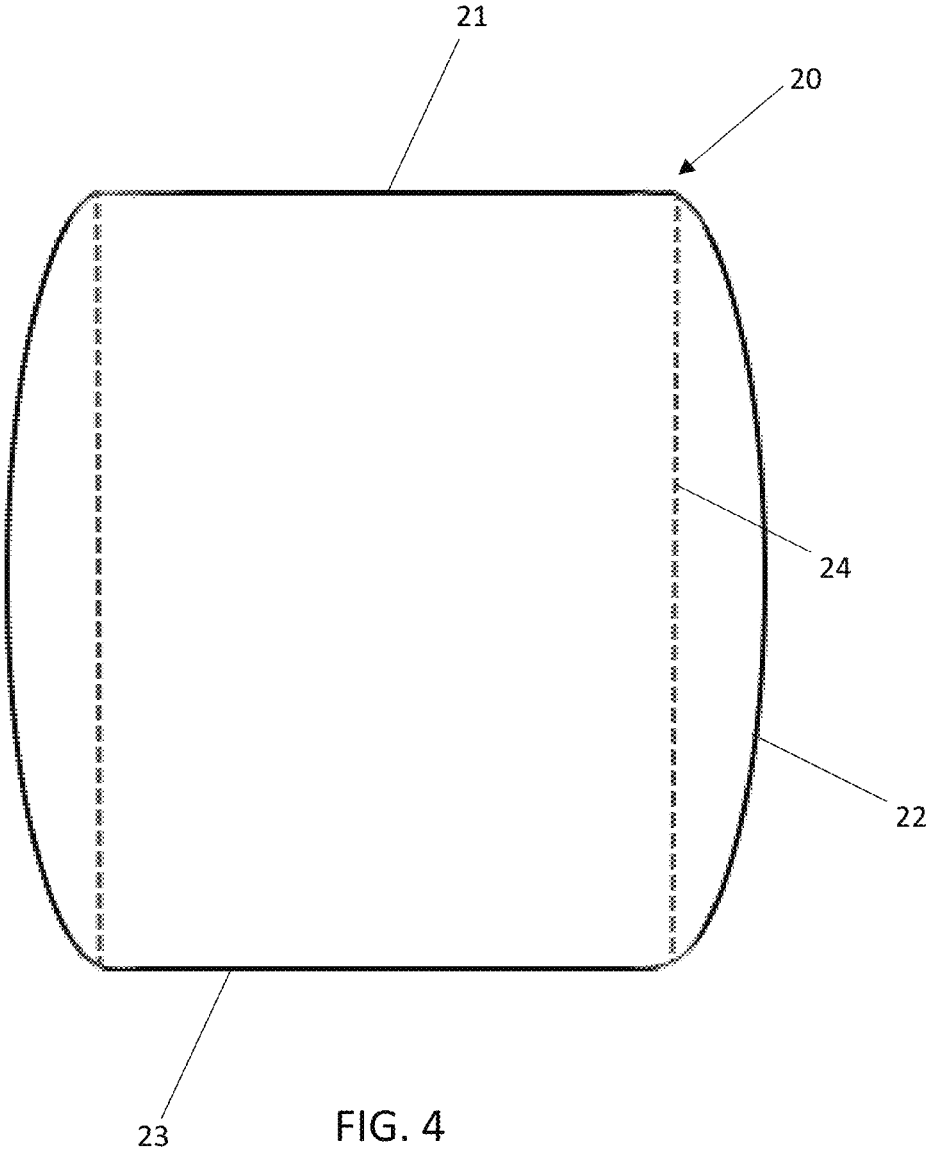
FIG. 4 illustrates a rear orthogonal view of a rounded container according to another embodiment of the present invention.

FIG. 4 illustrates a rear orthogonal view of a rounded container according to another embodiment of the present invention. In one embodiment, the rounded container 20 includes convex side panels 22. Convexity in this case is defined as the side panels 22 extending outwardly from the rounded container relative to a theoretically straight planar panel 24 between a top panel 21 and a bottom panel 23. Force exerted on side panels of containers frequently arises as a result of objects hitting the containers before, during, and/or after loading and/or unloading from an aircraft, or from the containers falling during loading and/or unloading from the aircraft. However, by having the side panels 22 be convex in shape, force exerted on the side panels 22 is more easily deflected from the rounded container 20 and is therefore less likely to damage the rounded container 20. In another embodiment, the top panel, front panel, and/or rear panel of the rounded container 20 are also convex.

The prior art teaches away from using convex side walls. The most common composite material for forming air cargo containers is fiberglass. However, one of ordinary skill in the art would not adapt a fiberglass container to have convex side walls. Unlike carbon fiber, fiberglass lacks sufficient tensile strength and workability to be able to function properly as a curved side panel between top and bottom panels. If fiberglass were to be formed into convex side walls, stress fractures soon form in the material, leading to increased likelihood of failure. Because failure of the container within an aircraft has the potential to be catastrophic (as does failure of any part within an aircraft), one of ordinary skill in the art would not adapt a fiberglass container to use this shape.

Figure 5:
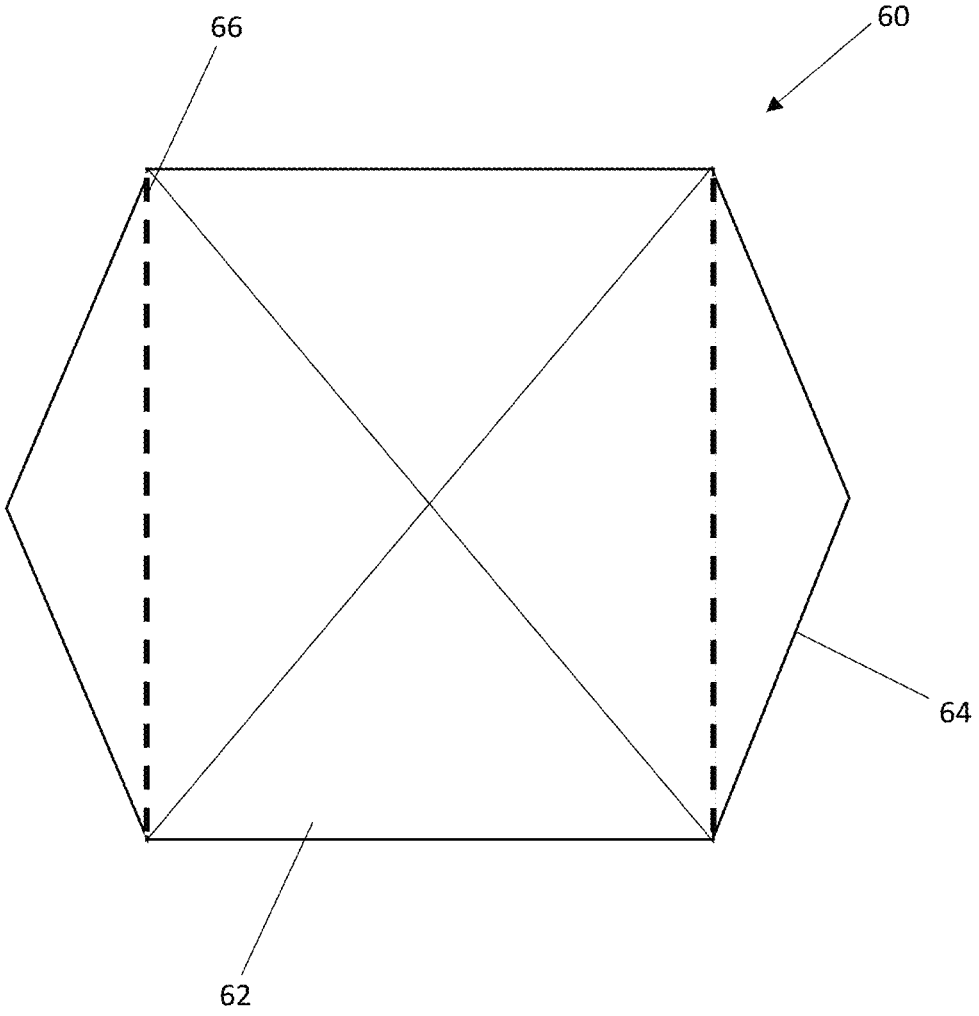
FIG. 5 illustrates an orthogonal side view of a container having triangular panels according to one embodiment of the present invention.

FIG. 5 illustrates an orthogonal side view of a container having triangular panels according to one embodiment of the present invention. One of ordinary skill in the art will understand that the shapes of the panels used for the side container are not intended to be limiting according to the present invention. In one embodiment, for example, the top, bottom, and/or each side wall of the container 60 are formed from a plurality of triangular side panels 62 (e.g., four triangular side panels meeting at a central point on the face of the container 60, as shown in FIG. 5). In one embodiment, the triangular side panels 62 do not form a planar surface. Instead, in one embodiment, the base of each of the triangular side panels forms an edge of the container 60 and extends inwardly toward the center of the face of the container 60 and outwardly away from the center of the container 60 as a whole. Therefore, from a side view, as shown in FIG. 5, the triangular side panels 64 extend outwardly relative to a theoretical plane 66 on which each of the bases of the triangular side panels 64 on a single face of the container 60 lie.

Figure 6:
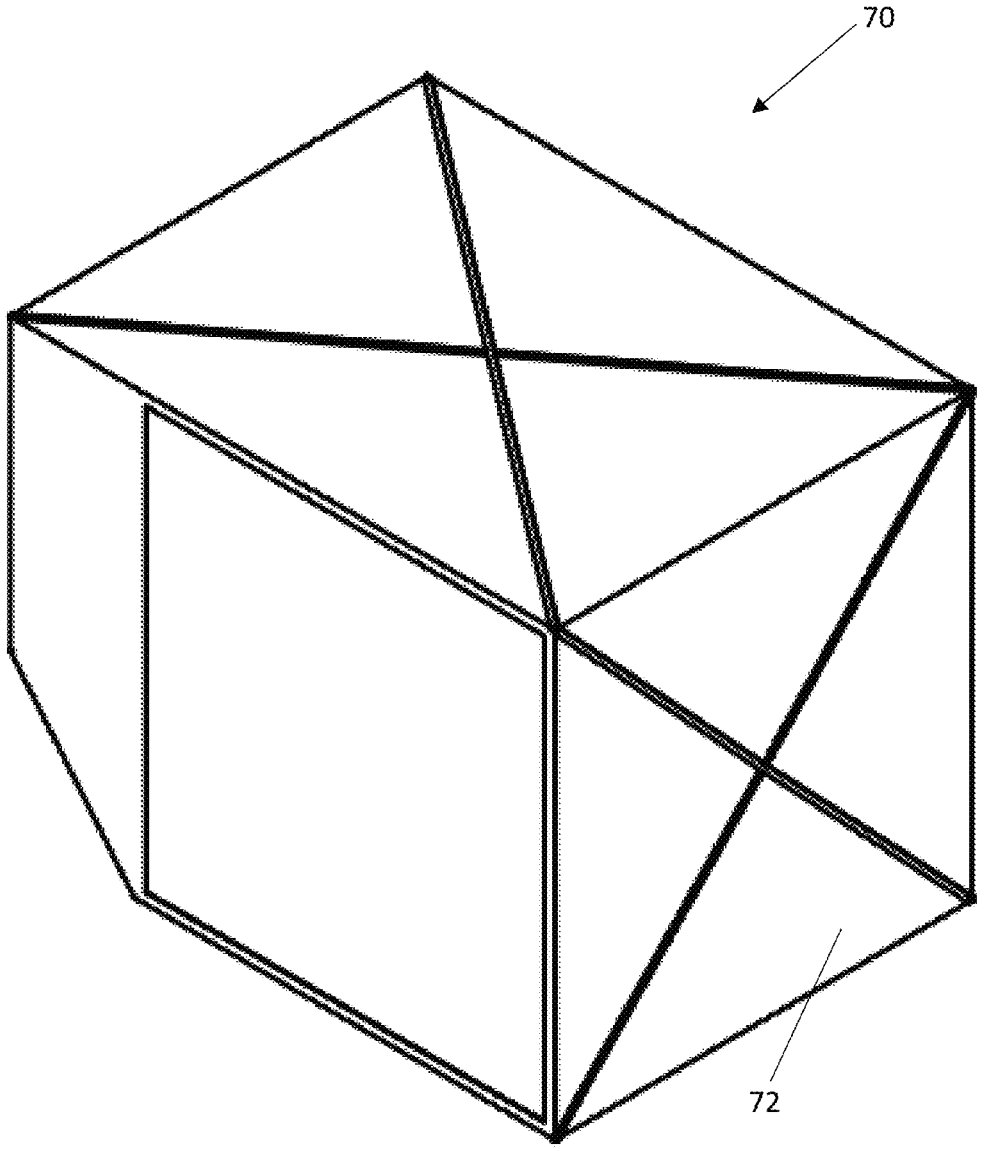
FIG. 6 illustrates an isometric view of a container having triangular panels according to one embodiment of the present invention.

FIG. 6 illustrates an isometric view of a container having triangular panels according to one embodiment of the present invention. In one embodiment, as shown in FIG. 6, the triangular panels 72 all lie along the same plane forming the side panel of the container 70, meaning that the sides of the container 70 do not bow out. This is useful in complying with standards set by ANSI that require containers to be flush with side walls of holding areas for the containers.

Figure 7:
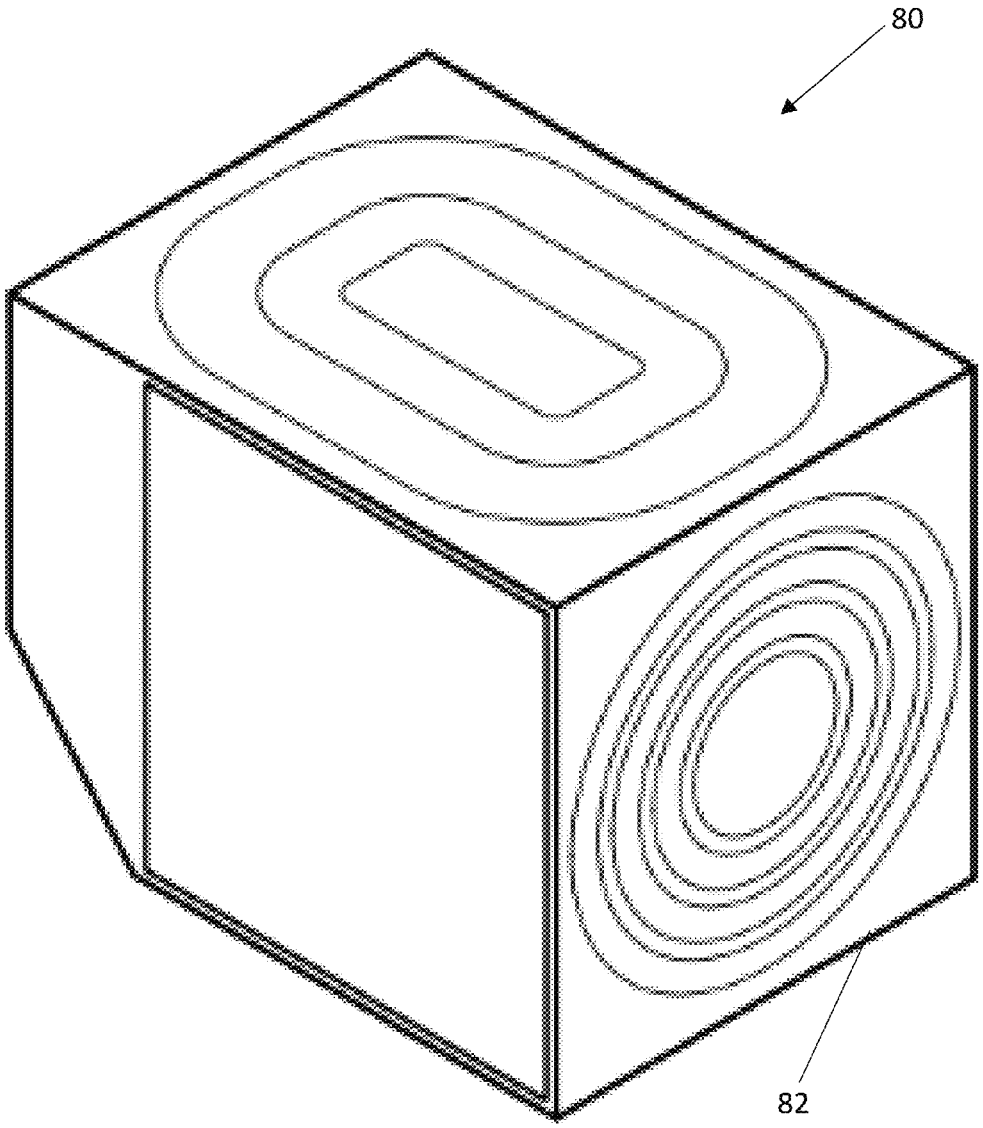
FIG. 7 illustrates an isometric view of a container having panels with ripple patterns according to one embodiment of the present invention.

FIG. 7 illustrates an isometric view of a container having panels with ripple patterns according to one embodiment of the present invention. In one embodiment, the side panels 82 of a container 80 include a ripple or wave-like pattern. The ripple or wave-like pattern describes a variation in fiber orientation of the fiber-reinforced composites constituting the panel 82. In one embodiment, during manufacture of the panels 82, the fibers are twisted about a central point. During this process, waves extending outwardly from the panel 82 develop. These waves are subsequently flattened such that the panel 82 has a substantially even thickness. Advantageously, a wave-like pattern provides the panels 82 with additional improved physical properties, such as rigidity and shear strength.

Figure 8:
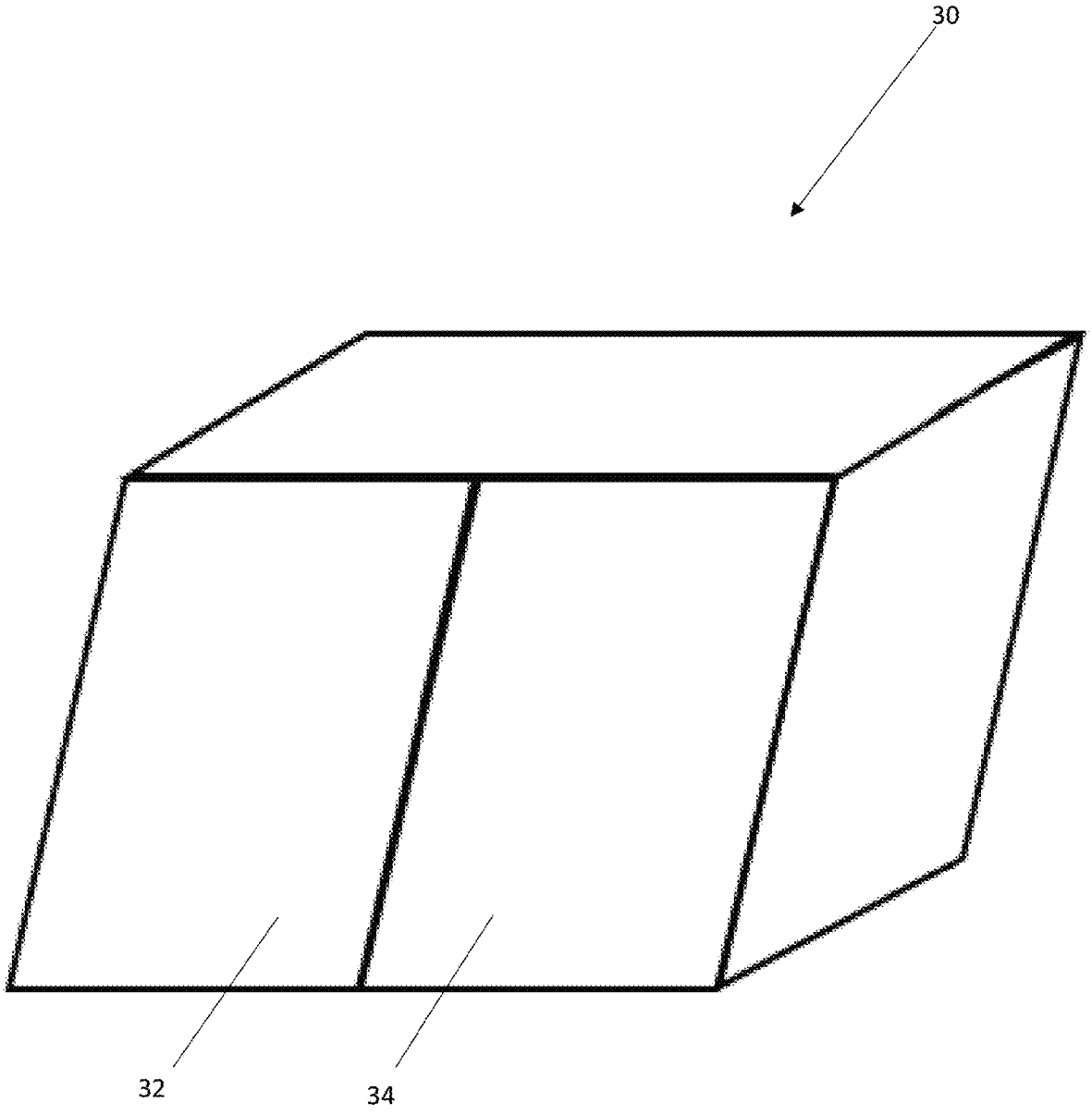
FIG. 8 illustrates an isometric view of a container with multiple side panels on each side according to yet another embodiment of the present invention.

FIG. 8 illustrates an isometric view of a container with multiple side panels on each side according to yet another embodiment of the present invention. In one embodiment, a multipaneled wall container 30 includes more than one panel on a single side. For example, FIG. 8, shows a container with a first panel 32 and a second panel 34 constituting a side wall. It should be appreciated that any side of the multipaneled wall container 30, including the top, bottom, front, back, and/or sides of the multipaneled wall container 30, is able to be comprised of more than one panel.

In one embodiment, each panel constituting the multipaneled wall container 30 or a subset of the panels constituting the multipaneled wall container 30 are identical parts. Forming multiple panels as identical parts allows the panels to be easily interchanged in the event of damage or other issues with other panels. Furthermore, using identical parts allows for easier maintenance and reduced down time for air cargo containers, as operators are able to quickly swap out the faulty panels of the air cargo containers with working panels and then continue to use the air cargo containers, while the faulty panels are fixed elsewhere.

It should be understood that panels are able to be joined in any manner known to the art, including, but not limited to, welding, adhesives, latches, hinges, nails, bolts, hook-and-loop fasteners, and/or fastening wires. Furthermore, panels on the same container are able to be joined in different manners. By way of example, and not of limitation, a bottom panel is able to be joined to a side panel via welding, while the same side panel is joined to a top panel with a hinge. Furthermore, in one embodiment, a plurality of the panels used for the container are formed as a single integral unit. By way of example, and not of limitation, a bottom panel and a side panel are laid up and cured as a single part. In another embodiment, the entire container is formed as a single integral part.

In one embodiment, the container is placed on a pallet or a skid. In one embodiment, the skid and/or pallet is formed from titanium, which has the benefit of increased strength and improved fire resistance as compared to, for example, aluminum skids and/or pallets. In another embodiment, the skid and/or pallet is formed from another metal, such as aluminum or steel, wood, and/or a composite material, such as carbon fiber or fiberglass. In yet another embodiment, the container is not placed on a pallet or a skid.

In one embodiment, the container is operable to collapse. In one embodiment, the locking mechanism of the container includes a latch, a button, a switch, and/or another triggering means that, when activated, causes the container to collapse. The container "collapsing" should be understood to mean that the front panel, rear panel, and side panels fold such that each of the panels is substantially flat. In one embodiment, a collapsed container includes all panels in a stacked orientation. In another embodiment, a collapsed container includes panels that are not all stacked, but each panel is oriented is substantially the same manner.

In one embodiment, panels are attached to other panels via at least one hinge. In one embodiment, the at least one hinge is formed from carbon fiber. When the container is in use, the panels are locked into place with respect to other panels by at least one locking mechanism. When the latch mechanism is released (e.g., a pin in the latch is removed), the panels are able to collapse. However, when the latch mechanism is in a locked state, the panels connected by the latch mechanism are held at a rigid angle. In one embodiment, the side panels, the front panel, and the rear panel are connected to the bottom panel by at least one latch mechanism. The top panel is connected to one of the side panels, the front panel, and/or the rear panel by at least one latch mechanism. In order to break down the container, each of the side panels, the front panel, and the rear panel have their at least one latch mechanism released such that they are able to collapse inward. The top panel then has its at least one latch mechanism released such that it lies flat on the rest of the panels. Nothing in this application should be understood to be limiting regarding which panels are connected by at least one latch mechanism. For example, in another embodiment, one side panel is latched to the front panel, the other side panel is latched to the rear panel, the top panel is latched to the rear panel, and the bottom panel is latched to the front panel.

In another embodiment, each panel of the container is individually detachable such that the panels are able to be stacked and reconstructed later. For embodiments in which the panels are individually detachable, it is particularly advantageous to include interchangeable panels. If the panels are interchangeable, then when the container is reconstructed, less care needs to be taken to ensure that specific parts are present. Instead, reconstructing a container merely requires that a minimum number of panels be present.

Figure 9:
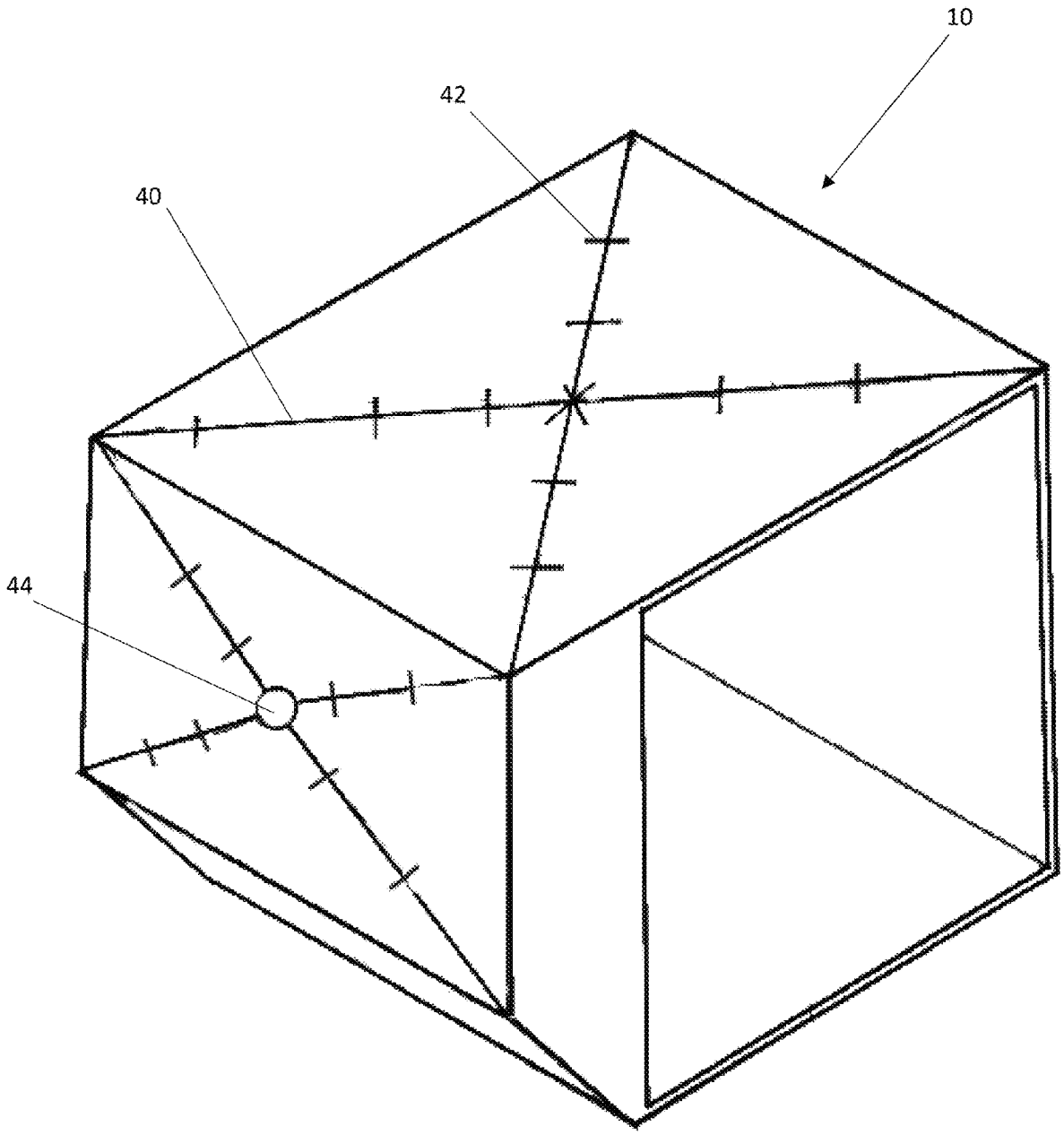
FIG. 9 illustrates an isometric view of a container having a cable-based sealing mechanism according to one embodiment of the present invention.

FIG. 9 illustrates an isometric view of a container having a cable-based sealing mechanism according to one embodiment of the present invention. In one embodiment, a container 10 includes a closing mechanism including at least one cable 40 running through a plurality of cable guides 42, and attached to at least one locking mechanism 44 (e.g., a gearbox). When the locking mechanism 44 is disengaged, the at least one cable 40 loosens, allowing the panels of the container 10 to separate and the container 10 to collapse. However, when the locking mechanism 44 is tightened (e.g., by a torque wrench, a socket wrench, a drill, or any other tool), the at least one cable 40 becomes increasingly taut, tightening around the panels to keep the container 10 together. In one embodiment, the locking mechanism 44 includes at least one gear, wherein the teeth of the at least one gear are engaged with a portion of the at least one cable and/or an extension attached to the at least one cable. When the locking mechanism 44 is tightened, the teeth of the at least one gear move, catching the at least one cable and causing the at least one cable to wrap around the at least one gear, thereby shortening the amount of the at least one cable outside of the locking mechanism 44 and tightening the at least one cable around the container 10. In one embodiment, the at least one cable 40 is the only locking mechanism for the container 10. In another embodiment, the at least one cable 40 is used in combination with one or more other mechanisms (e.g., latches). In one embodiment, the at least one cable 40 extends across a plurality of panels in a direction approximately 45° relative to the sides of the panels. In another embodiment, the at least one cable 40 runs approximately perpendicular to the sides of the panels. In yet another embodiment, the at least one cable 40 runs substantially along the seams between each panel.

Figure 10:
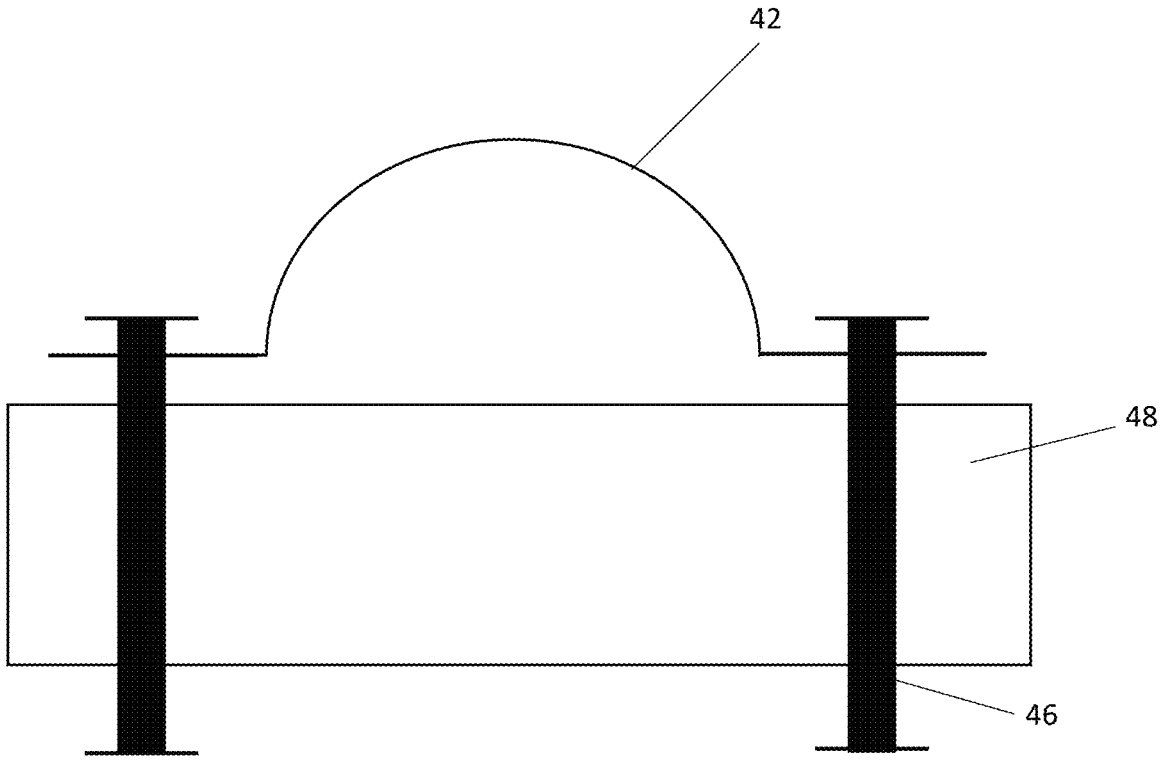
FIG. 10 illustrates a side view of a cable guide for a container according to one embodiment of the present invention.

FIG. 10 illustrates a side view of a cable guide for a container according to one embodiment of the present invention. In one embodiment, the container includes a plurality of cable guides 42. The at least one cable is able to be inserted under each of the plurality of cable guides 42 in order to keep the at least one cable close to the container. In one embodiment, each cable guide 42 is secured to the container via at least one rivet 46 extending through a panel 48 of the container. In another embodiment, screws, bolts, or other securing mechanisms are able to be used in lieu of the at least one rivet 46. In another embodiment, the container does not include any cable guides 42, and the at least one cable is instead loosely wrapped around the container before being tightened.

Figure 11:
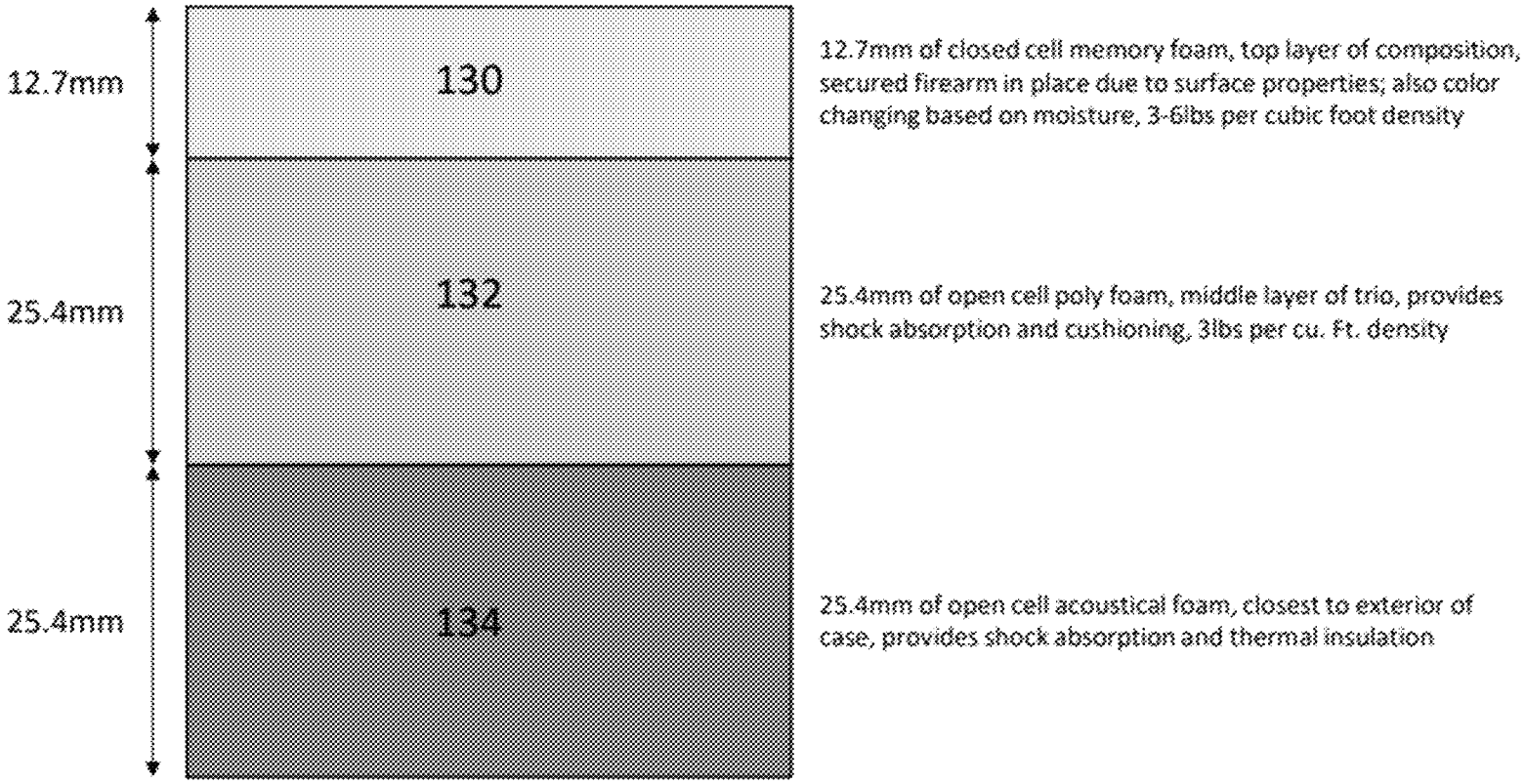
FIG. 11 illustrates a cross section of the three layers of foam included on the interior of a container in one embodiment of the present invention.

FIG. 11 illustrates a cross section of the three layers of foam included on the interior of a container in one embodiment of the present invention. In one embodiment, the interior of the container is coated with foam, wherein the foam includes an innermost layer 130, a middle layer 132, and an outermost layer 134. The innermost layer 130 or top layer of foam which contacts the contents of the container is a dense, lightweight foam which provides shock protection for the contents of the container. The innermost layer 130 of foam is preferably about 12.7 mm (about 0.5 inches) thick. Alternatively, the innermost layer 130 of foam is about 5.08 cm (2 inches) thick or between about 12.7 mm and about 5.08 cm thick. The innermost layer 130 of foam is preferably viscoelastic polyurethane foam or low-resilience polyurethane foam (LRPu) such as memory foam. The innermost layer 130 of foam is preferably closed cell, but is open cell foam in other embodiments. A preferred density of the innermost layer 130 of foam is between about 48.0554 kg per cubic meter to about 96.1108 kg per cubic meter (or about 3 to 6 pounds per cubic foot). The innermost layer of foam is preferably between about 0.635 cm (about 0.25 inches) and about 1.27 cm (about 0.5 inches) thick. Notably, the innermost layer of foam is operable to change color when a predetermined amount of moisture condenses on the foam. In one embodiment, the innermost layer of foam includes anhydrous cobalt (II) chloride, which is integrated in the foam during manufacture. By way of example, isocyanates including di-isocyanates, tri-isocyanates, poly-isocyanates, etc. and polyols are combined to form a polyurethane foam. The anhydrous cobalt (II) chloride is preferably combined with the isocyanates and the polyols to form the foam during manufacture of the foam. Alternatively, the anhydrous cobalt (II) chloride is added to the foam after the isocyanates and polyols are combined to form the foam. In another embodiment, color changing desiccants such as silica are integrated into the foam during the reaction between the isocyanates and the polyols or after the isocyanates have reacted with the polyols to form the foam. Color changing desiccants change color when exposed to moisture.

The middle layer 132 of foam is preferably a silicone-based compressive or memory foam on the interior to provide cushioning for the contents of the container and to prevent movement of the contents during transport. The middle layer 132 of foam is preferably about 25.44 mm (1 inch) thick. Alternatively, the foam is about 5.08 cm (2 inches) thick. The middle layer 132 is preferably an open cell polyurethane foam with a density of about 48.0554 kg per cubic meter (about 3 pounds per cubic foot).

The outermost layer 134 of foam is preferably an open cell acoustical foam with a thickness of about 48.0554 kg per cubic meter (about 3 pounds per cubic foot). Alternatively, the outermost layer 134 is a memory foam with a high friction coefficient to prevent the contents of the container from moving during transport. The outermost layer 134 is operable to be any foam which provides for thermal insulation and shock absorption. In another embodiment, the container includes no foam layers at all.

In one embodiment, the container includes an exterior shell having a plurality of layers. In one embodiment, the exterior shell is as described in U.S. Patent Publication No. 2021/0080224, which is incorporated herein by reference in its entirety. The outermost and innermost layers of the exterior shell are preferably formed from carbon fibers, and more preferably 3K carbon fibers. The middle layer of the exterior shell is preferable an insulating material, such as polystyrene (e.g., STYROFOAM), one or more thermoplastics, one or more thermosets, fiberglass, cellulose, NOMEX, polystyrene, polyurethane, and/or combinations thereof. The outermost layer and the innermost layer of the exterior shell are both preferably about 0.03048 cm (about 0.012 inches) thick. In another embodiment, the outermost layer and the innermost layer are about 0.127 cm (about 0.05 inches) thick. The middle layer of the exterior shell is preferably about 0.635 cm (about 0.25 inches) thick. In one embodiment, the shell is constructed from carbon fiber (with fibers being externally visible) with the addition of internal or external strips of any of the preceding middle layer materials. In one embodiment, the shell is constructed completely from carbon fibers with horizontally or vertically aligned strips or sheets of a meta-aramid material, such as honeycomb-shaped NOMEX, embedded within one or more layers of the shell.

Preferably, the exterior shell is laid up with epoxy impregnated 3K carbon fiber with a 2×2 twill weave and is cured for approximately 4 hours at 225 degrees Fahrenheit. After initial curing, a piece of core (e.g., ⅛-inch thick NOMEX with ⅛-inch honeycomb cell size) is embedded or attached to the shell. In another embodiment, unilateral carbon fibers are used in the exterior shell. In yet another embodiment, hybrid composites, including carbon fibers and high molecular-weight polypropylene, polyethylene, and/or other thermoplastics or thermosets are utilized. One example of a hybrid composite is INNEGRA manufactured by INNEGRA TECHNOLOGIES. In still another embodiment, carbon fibers are blended with steel fibers, titanium fibers, or other metal fibers to form one or more layers of the exterior shell. The carbon fiber notably adds stiffness to the container to prevent lateral torsion, while the core provides for strength while maintaining slight flexibility. In one embodiment, the tensile strength of the carbon fiber is between 500 MPa and 700 MPa. In another embodiment, the container is constructed with alternative materials and cores that provide a similarly tough but flexible construction. The shell, in one embodiment, is manufactured with, or integrally includes one or more layers for padding, durability, strength, and/or flexibility. Alternatives to 3K carbon fibers include 1K, 2K, 6K, 12K, 24K, and/or 48K carbon fibers. Any of the above recited materials are able to be utilized in any combination and in any number of layers to form the exterior shell of the container.

One of ordinary skill in the art will understand that the present invention is not limited to the use of carbon fiber technology, but is able to use other types of fiber-reinforced composite as well, including, but not limited to, aramid fiber-reinforced composites (e.g., KEVLAR, TWARON, etc.), basalt fiber-reinforced composites, and/or other types of fiber-reinforced composite materials. Furthermore, one of ordinary skill in the art will understand that the fiber orientations of the fiber-reinforced composites are not intended to be limiting according to the present invention. In one embodiment, the fibers of the fiber-reinforced composite are unidirectional, while in another embodiment, the fibers are woven. In one embodiment, each panel is formed from greater than one layer of fiber-reinforced composite, with different layers having unidirectional and/or woven fibers of the same or different orientations.

Nothing in the present application should be understood to limit the teachings to any particular type of air cargo container. By way of example, and not of limitation, the teachings of the present invention are able to apply to both containers designed for the lower deck and the main deck of an aircraft. For example, in one embodiment, the container is an LD-3 container. The present invention is understood to be able to apply to air cargo containers with size designation A, B, G, K, L, M, N, P, Q, R, S, and any other sized air cargo container. Furthermore, the teachings of the present invention are able to apply to air cargo containers having a variety of shapes, including having contours designated with letters A, B, C, D, E, F, G, H, J, K, L, M, N, P, U, V, X, Y, and Z, in addition to any other shape of air cargo container. In one embodiment, the container is able to be used with a frame or skid in order to transport the container. In one embodiment, the frame or skid is made from aluminum, titanium, and/or an aluminum-titanium alloy. Because the carbon fiber container has a reduced weight, additional strength, higher weight materials such as titanium are able to be used for the frame, while keeping the overall weight less than or equal to previous containers.

In one embodiment, an inside surface of one or more of the panels of the container is lined with an inflatable element connected to at least one pump, similar to the retaining bag disclosed in paragraph [00155] of U.S. Patent Publication No. 2021/0080224. The inflatable element is filled with a packaging material, such as Styrofoam, polystyrene beads, and/or polylactic acid beads. In one embodiment, the inflatable element includes an intake valve which, when opened, allows the inflatable element to take in air until the inflatable element is fully inflated. When cargo is placed inside of the container, the at least one pump is used to suction air out of the inflatable element such that the inflatable element deflates. As air is removed from the inflatable element, the packaging material becomes more compact and is able to more closely surround the cargo inside. This decreases the risk that the cargo will shift around and cause damaged or be damaged during flight. In another embodiment, the inflatable element is deflated when the cargo is added, and the at least one pump is used to add air to the inflatable element until it closely surrounds the cargo within.

The above-mentioned examples are provided to serve the purpose of clarifying the aspects of the invention, and it will be apparent to one skilled in the art that they do not serve to limit the scope of the invention. By nature, this invention is highly adjustable, customizable and adaptable. The above-mentioned examples are just some of the many configurations that the mentioned components can take on. All modifications and improvements have been deleted herein for the sake of conciseness and readability but are properly within the scope of the present invention.

The invention claimed is:

1. An air cargo container, comprising:

a frame defining a skeleton of the air cargo container;

a top panel and a bottom panel, attached to the frame via fasteners;

a plurality of side panels, each attached to the frame via fasteners; and at least one retaining bag attached to an interior surface of the top panel, the bottom panel, and/or one or more of the plurality of side panels;

wherein the frame, the top panel, the bottom panel, and the plurality of side panels define a sealed interior compartment of the air cargo container;

wherein at least one of the plurality of side panels is convex relative to the sealed interior compartment of the air cargo container; and wherein the at least one retaining bag includes packaging material and is operable to be inflated and/or deflated by a pump.

2. The air cargo container of claim 1, wherein the at least one of the plurality of side panels includes two side panels positioned on opposite sides of the air cargo container.

3. The air cargo container of claim 1, wherein the fasteners include screws, nuts, or nails, and wherein each of the fasteners are substantially identical.

4. The air cargo container of claim 1, wherein the top panel, the bottom panel, and/or the plurality of side panels are formed from carbon fiber, aramid fiber-reinforced composite, and/or basalt fiber-reinforced composite.

5. The air cargo container of claim 1, wherein the frame is formed from aluminum, titanium, and/or an aluminum-titanium alloy.

6. The air cargo container of claim 1, wherein the top panel, the bottom panel, and/or one or more of the plurality of side panels includes at least one door operable to open to the sealed interior compartment.

7. The air cargo container of claim 1, wherein the top panel, the bottom panel, and each of the plurality of side panels have approximately the same length, width, and thickness.

8. The air cargo container of claim 1, wherein the top panel, the bottom panel, and/or the one or more of the plurality of side panels includes an opening configured to allow the pump to inflate and/or deflate the at least one retaining bag while each of the top panel, the bottom panel, and the plurality of side panels are attached.

* * * * *